US005957727A

United States Patent [19]

Page, Jr.

[11] Patent Number: 5,957,727

[45] Date of Patent: Sep. 28, 1999

[54] ELECTRICAL CONNECTOR ASSEMBLY

[75] Inventor: Theron Vern Page, Jr., West Linn, Oreg.

[73] Assignee: The Whitaker Corporation, Wilmington, Del.

[21] Appl. No.: 08/960,690

[22] Filed: Oct. 29, 1997

Related U.S. Application Data

[60] Provisional application No. 60/049,949, Dec. 12, 1996.

[51] Int. Cl.[6] ..... H01R 13/648

[52] U.S. Cl. ..... 439/607; 439/936

[58] Field of Search ..... 439/76.1, 607, 439/610, 936

[56] References Cited

U.S. PATENT DOCUMENTS

| | | | |
|---|---|---|---|
| 4,179,178 | 12/1979 | Bachman et al. | 439/188 |
| 4,516,815 | 5/1985 | Venable et al. | 439/607 |
| 5,052,949 | 10/1991 | Lopata et al. | 439/610 |
| 5,108,294 | 4/1992 | Marsh et al. | 439/76.1 |
| 5,125,854 | 6/1992 | Bassler et al. | 439/607 |
| 5,132,871 | 7/1992 | Densham et al. | 439/76.1 |
| 5,171,161 | 12/1992 | Kachlic | 439/610 |
| 5,259,773 | 11/1993 | Champion et al. | 439/108 |
| 5,380,210 | 1/1995 | Grabbe et al. | 439/66 |
| 5,399,105 | 3/1995 | Kaufman et al. | 439/609 |
| 5,478,260 | 12/1995 | Kaufman et al. | 439/609 |

*Primary Examiner*—Neil Abrams
*Assistant Examiner*—T C Patel

[57] ABSTRACT

An electrical connector assembly (1) for a circuit board (2), the circuit board (2) being shielded by a conducting shield (4) encircling the circuit board (2), a conducting electrical contact (7) on the shield (4) providing a ground contact (7) for the shield (4), an insulating housing (5) encircling the shield (4) and the circuit board (2), with the connecting edge (3) on the circuit board (2) at a mating end (6) of the insulating housing (5), and the electrical contact (7) projecting outwardly of the insulating housing (5) and being bent over to register against an exterior of the insulating housing (5).

10 Claims, 4 Drawing Sheets

ELECTRICAL CONNECTOR ASSEMBLY

This application claims the benefit of U.S. Provisional Application No. 60/049,949 filed Dec. 12, 1996.

FIELD OF THE INVENTION

The invention relates to an electrical connector assembly, and particularly, to an electrical connector assembly that provides shielding for a circuit board, as well as, a plug connection for the circuit board.

BACKGROUND OF THE INVENTION

A video camera is often used in conjunction with an endoscope for medical and dental examinations. A continuing requirement for additional bandwidth must be met to enable high pixel count, video resolution, and higher rates of analog and digital signals that require processing. Such signals have increased fundamental frequencies and signal edge rates, which generate significant EMI/RFI emissions. Such emissions are required to be shielded against transmission into free space.

Electrical cables and electrical connector assemblies that are used with the video camera must shield against emission of outward bound EMI/RFI, and at the same time, shield the video electronics from electrical influences due to EMI/RFI radiating in the environment. In addition, the electrical cables and electrical connector assemblies that are used with the video camera must be sealed against virulent contaminants. Further, the electrical cables and electrical connector assemblies must withstand destructive environments of sterilization that involve elevated temperatures and chemicals encountered in an autoclave environment, as well as soaking in sterilization chemicals and oxidizing solutions.

A known electrical connector assembly is being used to connect an electrical cable to high resolution video camera apparatus in medical and dental environments. The known connector assembly comprises, a heavy metal connector housing that terminates an electrical cable to a circuit board inside the connector housing. The connector housing is of machined metal construction, and provides electrical shielding for the circuit board. The connector housing is further adapted as an electrical plug for plugging an edge of the circuit board into a mating socket on the video camera apparatus. A problem occurs with fracturing the circuit board when the connector is dropped, and the circuit board impacts a floor. A lower weight connector is desired, which will reduce the force of impact on the circuit board. A lower weight connector can be attained by substituting the heavy machined metal housing with a plastic connector housing combined with shielding that is stamped and formed from sheet metal.

A further difficulty is encountered in designing a plastic connector housing to meet EMI/RFI shielding requirements and a destructive sterilization environment. For example, U.S. Pat. No. 5,339,105 discloses, a combination of an electrical connector housing to which a stamped metal shield is assembled. The metal shield is assembled over an exterior of the housing. Spring fingers 32 on the shield are bent over to extend into an open end of the housing. This known connector housing has the shielding on the exterior of the connector, which is less effective than a shield on an interior of the connector housing. No provision is made for sealing the connector housing, and for withstanding a destructive sterilization environment.

SUMMARY OF THE INVENTION

According to the invention an electrical connector assembly comprises, an insulating connector housing and a thin metal shield on an interior of the housing that provides more effective shielding than would a shield on an exterior of the housing.

According to an embodiment of the invention, an electrical contact on the shield projects outwardly from the interior of the housing, and is bent over to register against an exterior of the housing. An advantage resides in the contact being unitary with the shield to provide an external contact for the shield inside the housing.

According to a further embodiment, a portion of the electrical contact penetrates the housing to be anchored to the housing.

According to a further embodiment, a portion of the electrical contact penetrates the housing and electrically connects with the shield to reduce the resistance of the electrical contact by providing a circuit path extending from the shield and along said portion of the electrical contact.

According to a further embodiment, a cable gripping portion on the shield is adapted to provide a strain relief for an electrical cable that connects with the circuit board. An electrical contact on the shield extends along an exterior of an insulating housing, and a portion of the electrical contact penetrates the housing and electrically connects with the shield adjacent to the strain relief, thereby, providing an electrical path of reduced electrical resistance from the cable to the electrical contact.

A preferred embodiment of the invention will now be described, by way of example, with reference to the accompanying drawings, according to which:

DETAILED DESCRIPTION

Figure 1:
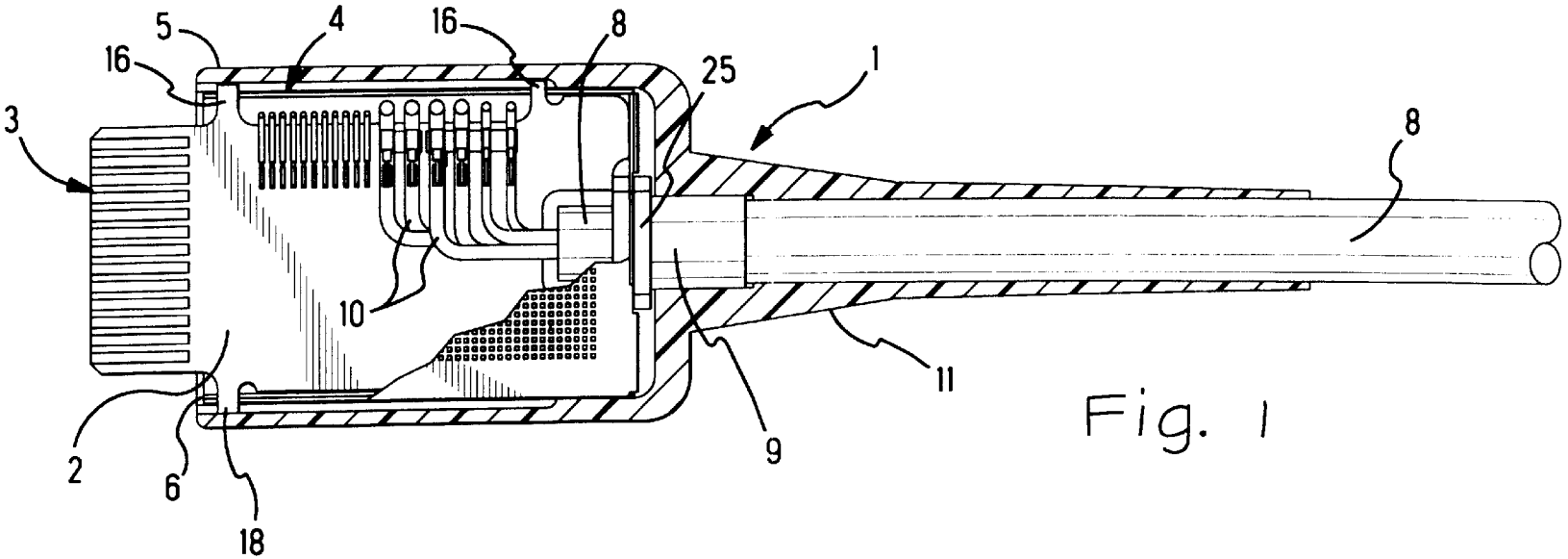
FIG. 1 is a top view of an electrical connector assembly with parts in section and with parts cut away.
Figure 2:
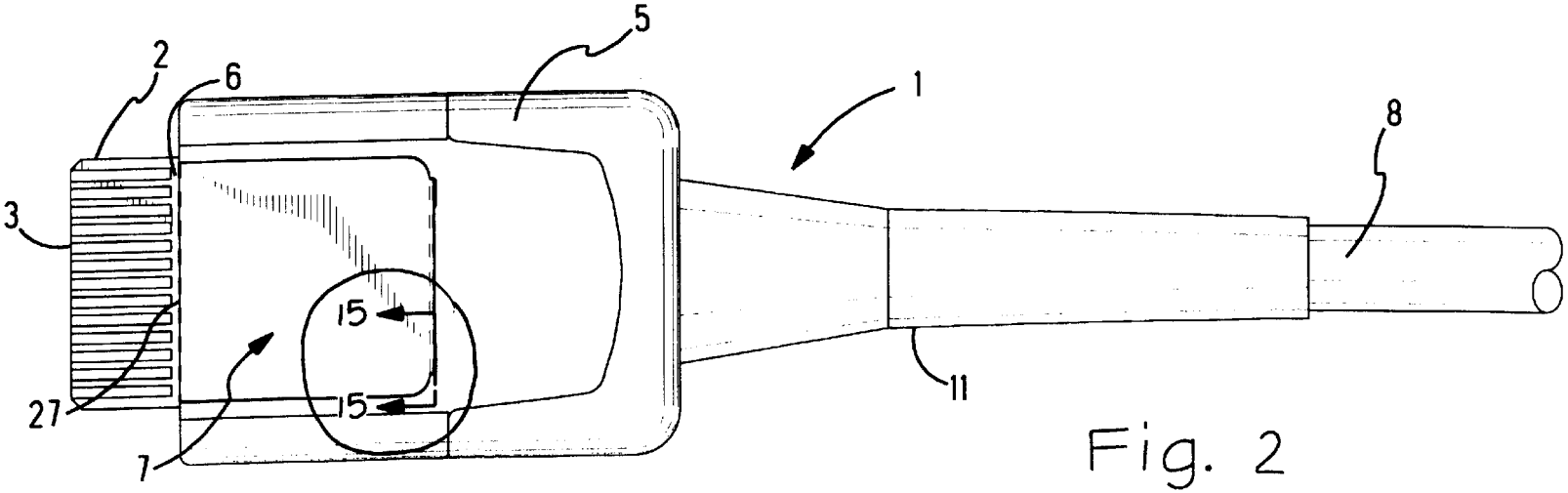
FIG. 2 is a bottom view of the electrical connector assembly, as shown in FIG. 1.
Figure 3:
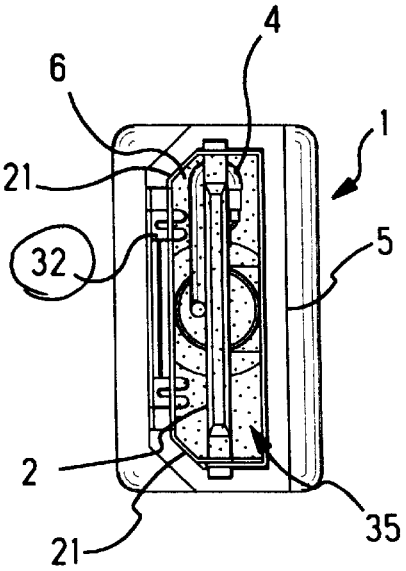
FIG. 3 is an end view of the electrical connector assembly, as shown in FIGS. 1 and 2.
Figure 14:
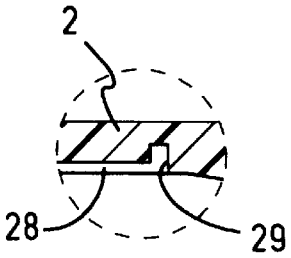
FIG. 14 is an enlarged view of a portion of the insulating housing, as shown in FIG. 12.
Figure 5:
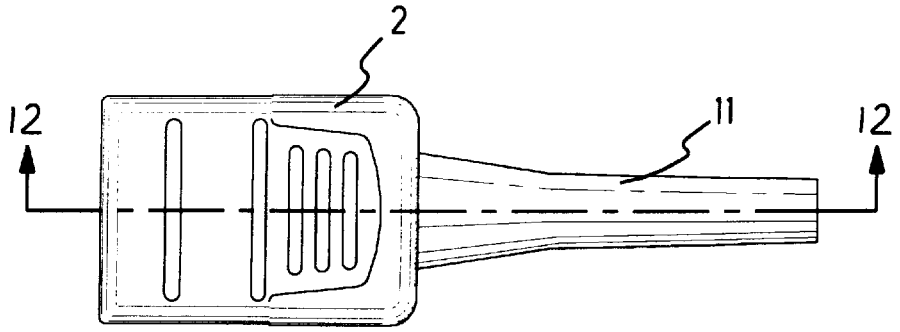
FIG. 5 is a top view of an insulating housing of the connector assembly as shown in FIG. 1.
Figure 7:
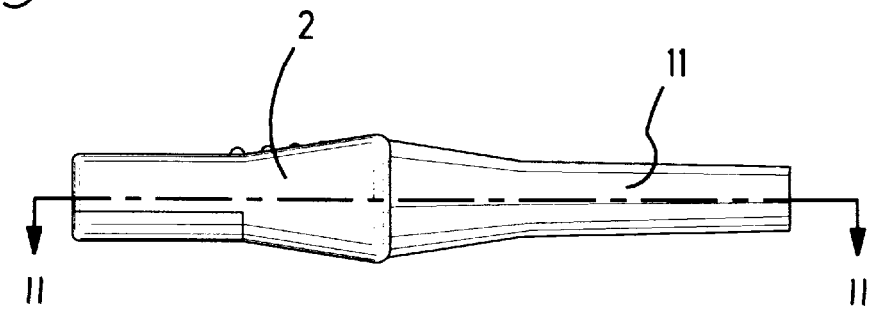
FIG. 7 is a side view of the insulating housing, as shown in FIG. 5.
Figure 8:
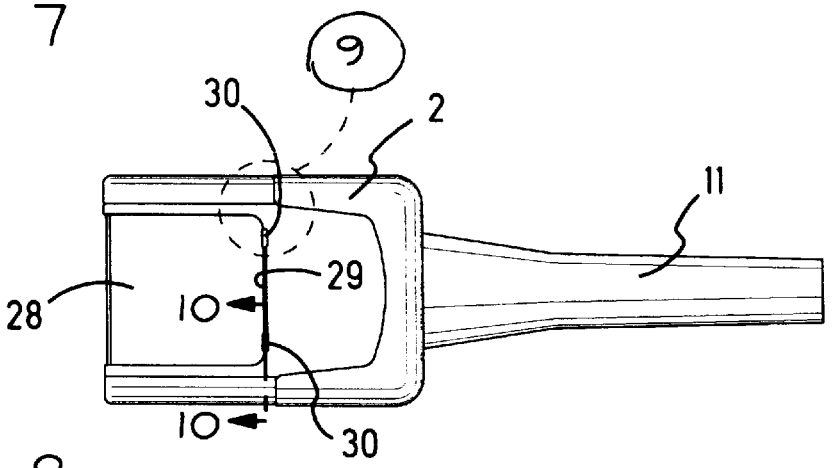
FIG. 8 is a bottom view of the insulating housing, as shown in FIG. 5.
Figure 11:
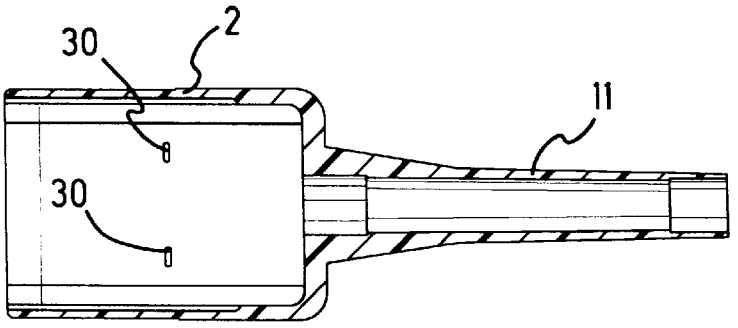
FIG. 11 is a section view taken along the line 11—11 of FIG. 7.
Figure 6:
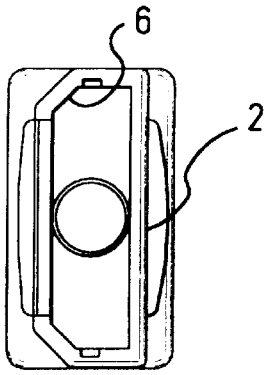
FIG. 6 is an end view of the insulating housing, as shown in FIG. 5.
Figure 10:
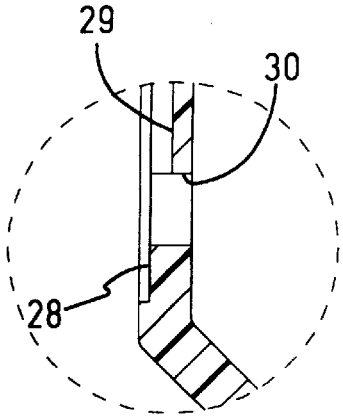
FIG. 10 is an enlarged section view taken along the line 10—10 of FIG. 8.

With reference to FIGS. 1–3, an electrical connector assembly 1 electrically terminates a circuit board 2, and provides a disconnect electrical connection for a connecting edge 3 on the circuit board 2. The circuit board 2 is shielded by a conducting shield 4 encircling the circuit board 2. An insulating housing 5 encircles the shield 4 and the circuit board 2, with the connecting edge 3 on the circuit board 2 at an open mating end 6 of the insulating housing 5. A conducting electrical contact 7 on the shield 4 provides a ground contact for the shield 4, the electrical contact 7 projecting outwardly of the insulating housing 5 and being bent over on itself to register against an exterior of the insulating housing 5. The electrical connector assembly 1 terminates the circuit board 2, and adapts the circuit board 2 for disconnect electrical connection of the connecting edge 3.

An electrical cable 8 is terminated by the circuit board 2 and by the electrical connector assembly 1. First, the cable 8 is passed through a hollow cylindrical, flanged crimp sleeve 9, and through the housing 5. An encircling shield on the cable 8 is surrounded and contacted by the crimp sleeve 9. The cable 8 has an interior constructed of multiple coaxial cables 10 that project from a remainder of the cable 8, and into the insulating housing 5, and electrically connect with respective conducting lands on the circuit board 2. A tubular shaped, flexible strain relief portion 11 on the housing 5 encircles the electrical cable 8, and provides bending strain relief for the cable 8. Accordingly, the cable 8 is terminated by the electrical connector assembly 1 and by the circuit board 2.

Figure 4:
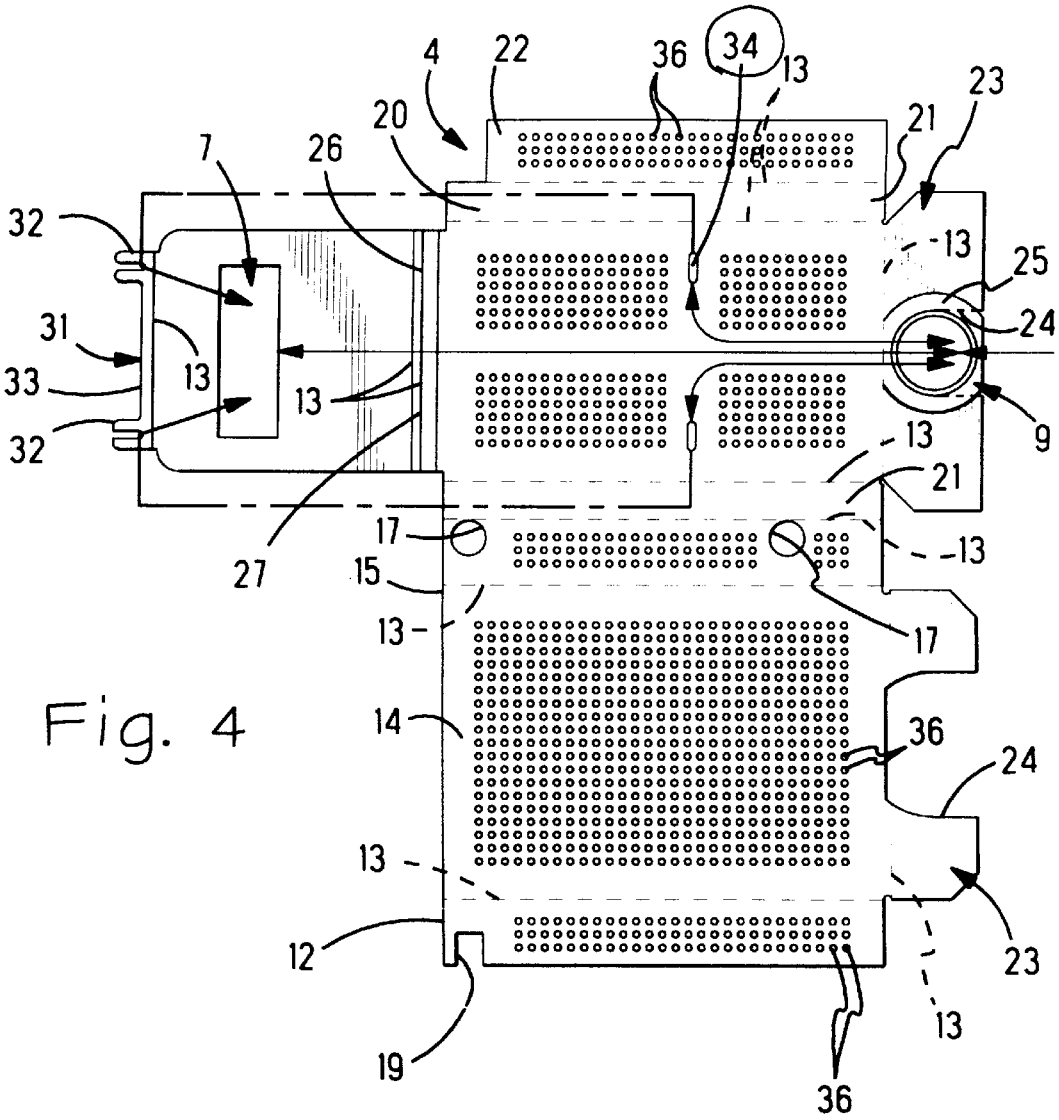
FIG. 4 is a top view of a development of a foldable, one-piece, sheet metal shield of the electrical connector assembly, as shown in FIG. 1.

With reference to FIG. 4, the shield 4 will now be described. The shield 4 comprises, a foldable, one-piece metal sheet. The metal sheet becomes folded to form an enclosure for the circuit board 2. The shield 4 comprises, a first side wall 12 for the enclosure connected along a fold line 13 to a flat bottom wall 14, in turn, connected along a fold line 13 to a second side wall 15. The first side wall 12 and the second side wall 15 are folded along respective fold lines 13 to project upward from the bottom wall 14. The circuit board 2, which has been connected to the cable 8, is positioned between the first side wall 12 and the second side wall 15.

Projecting tabs 16 along one edge of the circuit board 2 register with spaced apart openings 17 through the second side wall 15. Another projecting tab 18 on an opposite edge of the circuit board 2 will register with an open end slot 19 through the first side wall 12. For example, the shield 4 is pivoted relative to the circuit board 2 to register the slot 19 with said another projecting tab 18 on the circuit board 2. The circuit board 2 is then suspended within the shield 4.

A top wall 20 on the shield 4 has beveled edges 21 formed by bending along parallel, lateral fold lines 13. One of the beveled edges 21 connects along a corresponding fold line 13 to the second side wall 15. Another of the beveled edges 21 connects along a corresponding fold line 13 to a flap 22. The flap 22 overlaps the first side wall 12 when the metal sheet is folded to form an enclosure for the circuit board 2.

Inner end flaps 23 are connected by respective fold lines 13 to the bottom wall 14 and the top wall 20. When the inner end flaps 23 overlap, a crimp sleeve 9 receiving recess 24 in each end flap 23 closes over the crimp sleeve 9. Advantageously, the crimp sleeve 9 is conducting, and is electrically grounded to the shield of the cable 8 and to the inner end flaps 23. Further, the inner end flaps 23 overlap a flanged portion 25 of the crimp sleeve 9, and provides tensile strain relief that resists tension on the cable 8.

With reference to FIGS. 4 and 8–14, the electrical contact 7 will now be described. Although a single electrical contact 7 will be described, multiple electrical contacts 7 of the same construction can be provided on adjacent exterior surfaces of the housing 5. Each electrical contact 7 projects longitudinally from a mating front edge 26 on the top wall 20, and is connected by multiple fold lines 13, which when folded, that are closely spaced to impart a flared lip 27 along the front open mating end of the shield 4. The housing 5 is slid along the cable 8 to encircle the shield 4. The shield 4 is between the circuit board 2 and the insulating housing 5. The electrical contact 7 is bent over, by folding along the fold lines 13, to register against an exterior of the housing 5. The housing 5 has a thickness between the shield 4 and the electrical contact 7 that is against said exterior of the housing 5. The electrical contact 7 registers in a recess 28 in the exterior of the housing 5. The recess 28 extends from the front, mating end 6 of the housing 5 and rearwardly. A narrow cavity 29 extends in the thickness of the housing 5. The cavity 29 connect with spaced apart slits 30 extending through the thickness of the housing 5.

Figure 15:
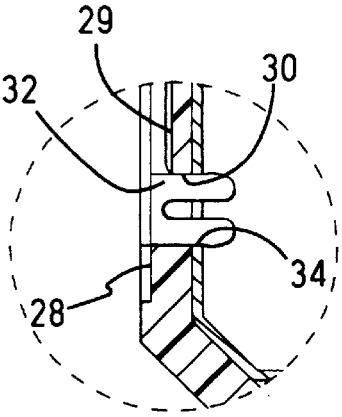
FIG. 15 is a section view taken along the line 15—15 of FIG. 2.
Figure 9:
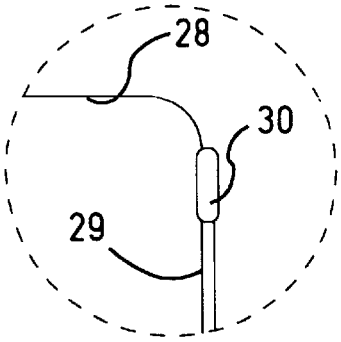
FIG. 9 is an enlarges view of a portion of the insulating housing as shown in FIG. 8.
Figure 13:
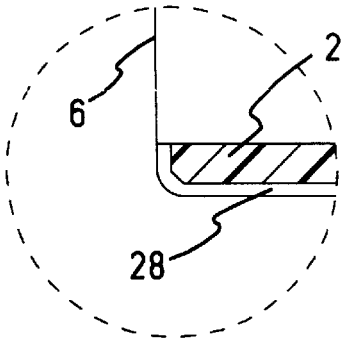
FIG. 13 is an enlarged view of a portion of the insulating housing, as shown in FIG. 12.
Figure 12:
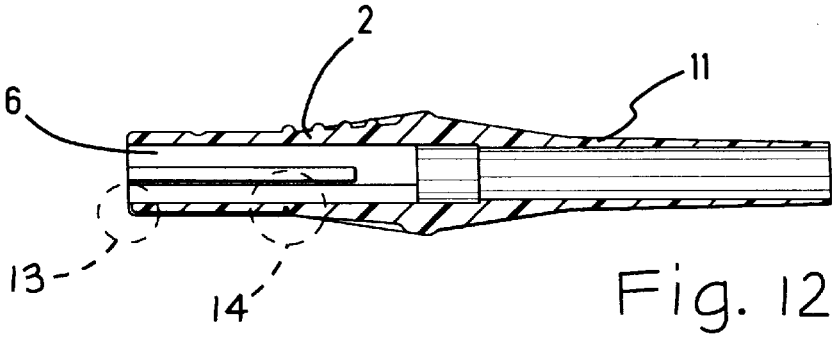
FIG. 12 is a section view taken along the line 12—12 of FIG. 5.

With reference to FIG. 4, a portion 31 of the electrical contact 7 comprises, pairs of spring fingers 32 projecting from a flanged edge 33 on the electrical contact 7. The flanged edge 33 is bent up along a fold line 13 to project transversely with the plane of the remainder of the electrical contact 7. When the electrical contact 7 is bent over, the flanged edge 33 registers in the cavity 29 in the thickness of the housing 5, and the spring fingers 32 project through corresponding slits 30 as shown in FIG. 15. Thus, said portion 31 of the electrical contact 7 is anchored in the exterior of the housing 5.

The top wall 20 of the shield 4 is provided with closed ended slots 34 into which the pairs of spring fingers 32 are received with a friction fit. Said portion 31 of the electrical contact 7 is provided to penetrate the housing 5 and electrically connect with the shield 4 to reduce the resistance of the electrical contact 7 by providing a circuit path extending from the shield 4 and along said portion 31 of the electrical contact 7. For example, the electrical contact 7 penetrates the housing 5 and electrically connects with the shield 4 adjacent to the cable 8 contacting strain relief portion. The electrical path from the cable 8 to the electrical contact 7 is substantially shortened, to improve shunting of EMI/RFI away from the mating end 6 of the connector assembly 1.

The circuit board 2 and the terminated cable 8 are encapsulated, for example, by epoxy sealant 35, deposited in the open mating end 6 of the housing 5. Multiple vent openings 36 through the shield 4 receive the epoxy vent openings 36. The vent openings 36 are distributed over the shield 4 to promote flow of the sealant 25 to all open spaces between the circuit board 2 and the shield 4 and the interior of the housing 5. The vent openings 36 further provide vents to avoid pockets of entrapped air. The vent openings 36 are confined to areas of the shield 4 that are adjacent to the shortest electrical paths from the inner end flaps 23 to the ground contact 7. For example, the shortest electrical path from the inner end flaps 23 to the spring fingers 32 is devoid of the flow promoting vent openings 36 through the shield 4, to improve shunting of EMI/RF away from the mating end 6 of the connector assembly 1. Further the shortest electrical path from the inner end flaps 23 to the mating end 6 is devoid of the vent openings 36 to improve continuity of the shield 4 along the length, front to rear.

An advantage of the invention resides in an electrical connector assembly 1 that is fully shielded, and environmentally sealed.

I claim:

1. An electrical connector assembly comprising: a circuit board, the circuit board having a connecting edge, the circuit board being shielded by a conducting shield encircling the circuit board, a conducting electrical contact on the shield providing a ground contact for the shield, an insulating housing encircling the shield and the circuit board, with the connecting edge on the circuit board at a mating end of the insulating housing, and the electrical contact projecting outwardly of the insulating housing, being bent over the insulating housing and penetrating the insulating housing to electrically connect with the shield adjacent a cable contacting strain relief portion.

2. An electrical connector assembly as recited in claim 1 wherein, insulating encapsulant in the interior of the housing is received in openings through the shield, the openings being distributed over the shield to promote flow of the encapsulant.

3. An electrical connector assembly as recited in claim 1 wherein, the housing has a thickness between the shield and the electrical contact against said exterior of the housing.

4. An electrical connector assembly as recited in claim 1 wherein, a portion of the electrical contact is anchored in the exterior of the housing.

5. An electrical connector assembly as recited in claim 1 wherein, the shield is between the circuit board and the insulating housing.

6. An electrical connector assembly as recited in claim 1 wherein, multiple electrical contacts are provided on adjacent exterior surfaces of the housing.

7. A shield for an electrical connector comprising:

a one piece metal sheet being formed to have a first portion disposed along an interior of an insulative housing, a contact portion disposed along an exterior of the insulative housing, an edge having fingers extending from the contact portion through the insulative housing to contact the first portion, and a crimp sleeve extending from the first portion.

8. A shield as recited in claim 7 further comprising at least one slot disposed along the first portion for receiving the fingers.

9. An electrical connector having an insulative housing surrounding a circuit board, the electrical connector comprising:

a shield being formed to have a first portion disposed along an interior of the insulative housing and substantially surrounding the circuit board, a contact portion disposed along an exterior of the insulative housing, fingers extending from the contact portion through the insulative housing to contact the first portion, and a crimp sleeve extending from the first portion.

10. An electrical connector as recited in claim 9 wherein a portion of the contact portion is anchored along the exterior of the insulative housing.

* * * * *